US007718877B2

(12) United States Patent
Swinkels

(10) Patent No.: US 7,718,877 B2
(45) Date of Patent: May 18, 2010

(54) DEVICE AND MUSICAL INSTRUMENT

(75) Inventor: Franciscus Johannes Marie Swinkels, Thorn (NL)

(73) Assignee: Adams Paukenfabriek B.V., Ittervoort (NL)

( * ) Notice: Subject to any disclaimer, the term of this patent is extended or adjusted under 35 U.S.C. 154(b) by 0 days.

(21) Appl. No.: 12/381,309

(22) Filed: Mar. 10, 2009

(65) Prior Publication Data

US 2009/0229443 A1 Sep. 17, 2009

(30) Foreign Application Priority Data

Mar. 12, 2008 (NL) ..... 2001366

(51) Int. Cl.
*G10D 13/02* (2006.01)

(52) U.S. Cl. ..... 84/411 R

(58) Field of Classification Search ..... 84/411 R, 84/413–415, 419

See application file for complete search history.

(56) References Cited

U.S. PATENT DOCUMENTS 1,356,193 A 10/1920 Danly
3,163,075 A 12/1964 Toperzer et al ..... 84/419
4,122,749 A 10/1978 Hoellerich ..... 84/419
6,410,833 B1 * 6/2002 Brando ..... 84/411 R

* cited by examiner

*Primary Examiner*—Kimberly R Lockett
(74) *Attorney, Agent, or Firm*—Michaelson & Associates; Peter L. Michaelson

(57) ABSTRACT

The invention relates to a device for setting skin tension, in particular for use in a musical instrument such as a kettle-drum. The device comprises a tensioning star provided with an engaging element for engaging an operating mechanism for adjusting the tensioning star in an axial adjusting direction, substantially parallel to a central axis of the tensioning star. The tensioning star is also provided with a plurality of arms extending substantially in radial directions of which at least a part is provided with a coupling element for coupling to a tensioning rod construction attachable to the skin. In addition, the device comprises an adjusting device for adjusting the distance between a coupling element and the central axis of the tensioning star.

14 Claims, 3 Drawing Sheets

DEVICE AND MUSICAL INSTRUMENT

BACKGROUND OF THE INVENTION

Field of the Invention

The invention relates to a device for setting skin tension, in particular for use in a musical instrument such as a kettledrum, comprising a tensioning star provided with an engaging element for engaging an operating mechanism for adjusting the tensioning star in an axial adjusting direction, substantially parallel to a central axis of the tensioning star, and provided with a plurality of arms extending substantially in radial directions, of which at least a part is provided with a coupling element for coupling to a tensioning rod construction attachable to the skin.

Such a device is known from practice, as part of, for instance, a commercially available kettledrum.

SUMMARY OF THE INVENTION

The object of the invention is a device according to a type mentioned in the opening paragraph, with which the skin tension can be set independently of a pedal provided on the operating mechanism. To that end, according to the invention, the device further comprises an adjusting device for adjusting the distance between a coupling element and the central axis of the tensioning star.

Using an adjusting device for adjusting the distance between coupling element and the central axis of the tensioning star allows for the skin tension to be set independently of the operating mechanism for adjusting the tensioning star in axial direction. Here, the balance between the operating mechanism and the tensioning star is maintained. Thus, the skin tension can be regulated independently of a position of the operating mechanism, so that a user/player can work with standard positions of the operating mechanism, which, in an advantageous manner, can increase the ease of use and/or the player comfort to a considerable extent.

In an advantageous embodiment according to the invention, the operating device comprises a first connecting rod which engages with a first end the engaging element of the tensioning star, further a second connecting rod which is attached by a first end to a coupling module which is couplable to a second end of the first connecting rod, while the coupling module comprises a clamping construction which is designed for a clamping coupling to the first connecting rod within a predetermined adjustment range in the axial adjusting direction, between a minimum distance and a maximum distance relative to the skin, and which is designed for releasing the clamping coupling when, through an adjustment of the second connecting rod, the distance between the first connecting rod and the skin becomes smaller than the minimum distance of the adjustment range.

As a result, a coupling is obtained between parts of the operating mechanism which can be disassembled relatively simply so that the device can be modularly transported and built up by a user/player. Naturally, the device can also be realized without such a coupling, for instance for obtaining a less expensive construction.

In an advantageous embodiment according to the invention, the operating device further comprises a hingedly arranged coupling piece which is coupled to the second connecting rod, to an operating rod attached to a pivotal pedal, and to a biased spring element, with the operating rod oriented substantially transversely to the axial adjusting direction, while the force provided by the biased spring element is oriented from the coupling piece in a direction between the tensioning star and the pedal. Thus, in an elegant manner, a force equilibrium can be obtained between the pedal and the force provided by the skin on the operating mechanism, over a practically usable range of the pedal.

The invention further relates to a musical instrument.

Further advantageous embodiments of the invention are represented in the subclaims.

BRIEF DESCRIPTION OF THE DRAWINGS

The invention will be explained in further detail on the basis of exemplary embodiments which are represented in the drawing. In the drawing:

The Figures are only a schematic representation of a preferred embodiment of the invention. In the Figures, identical or corresponding parts are indicated with the same reference numerals.

FIGS. 1 and 2 show a schematic side view and a schematic view, respectively, of a cross section of a kettledrum 100 according to the invention.

DETAILED DESCRIPTION

Figure 2:
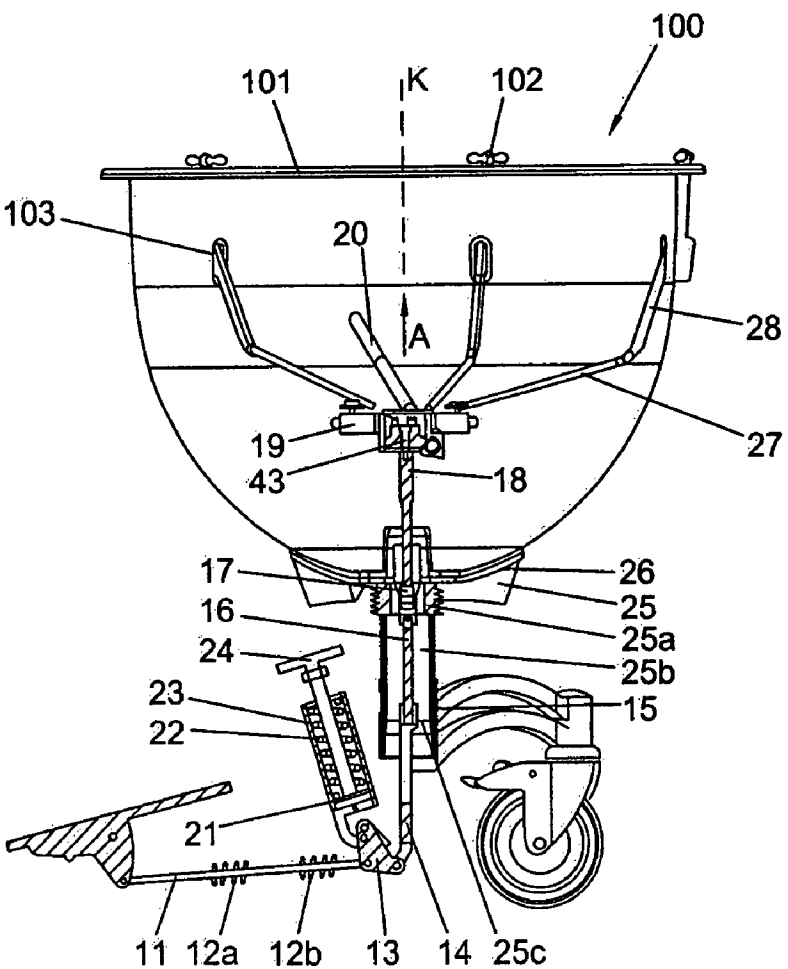
FIG. 2 shows a schematic view of a cross section of the kettledrum of FIG. 1.
Figure 1:
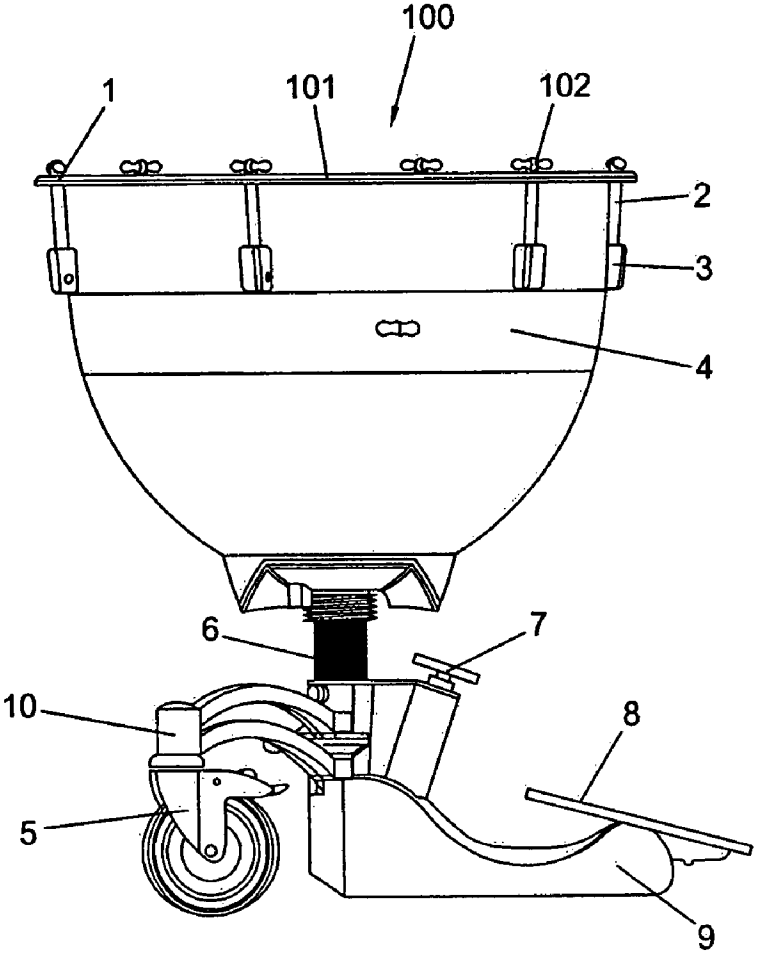
FIG. 1 shows a schematic side view of a kettledrum according to the invention.

The kettledrum 100 comprises a kettle 4 which is borne by a foot 9. The kettle 4 is manufactured from metal and serves as a sound box. Over the kettle 4 a skin 101 is stretched with the aid of a tensioning ring 1 which is provided adjacent the top edge of the kettle 2. With the aid of tensioning nuts 102 and tensioning rods 2 connected thereto, the tensioning ring 1 is drawn downwards so that the skin 101 is tensioned. The tensioning rods 2 comprise an upper rod 28 and lower rod 27 hinged thereto. The tensioning rods 2 extend partly along the outside of the kettle 4, reach via a support 3 and an opening 103 located nearby into the kettle 4 and are coupled via coupling elements to a tensioning star 19 described hereinbelow in more detail. Through adjustment of the tensioning nuts 102, the effective length of the tensioning rods 2 can be set such that between the tensioning nuts 102 and the tensioning star 19, the tensioning rods 2 have the same length within a particular accuracy, so that the tensioning star 10 extends at least substantially horizontally. The construction of tensioning rods 2, including the upper rod 28 and lower rod 27, the tensioning nuts 102 and the tensioning ring 1 forms a tensioning rod construction for tensioning the skin 101.

The tension in the skin 101 can be adjusted by moving the tensioning ring 19 in an adjusting direction oriented substantially horizontally. The fact is that by moving the tensioning star 19 in the adjusting direction, via the tensioning rods of the tensioning rod construction, also, the tension ring 1 moves in the adjusting direction, so that the skin 101 is pulled tauter or less taut depending on the direction of movement of the tensioning star 19. The fact is that this movement induces a movement of the tensioning brackets. By playing a tensioned skin, a low-noise, consonant tone can be generated.

Figure 3:
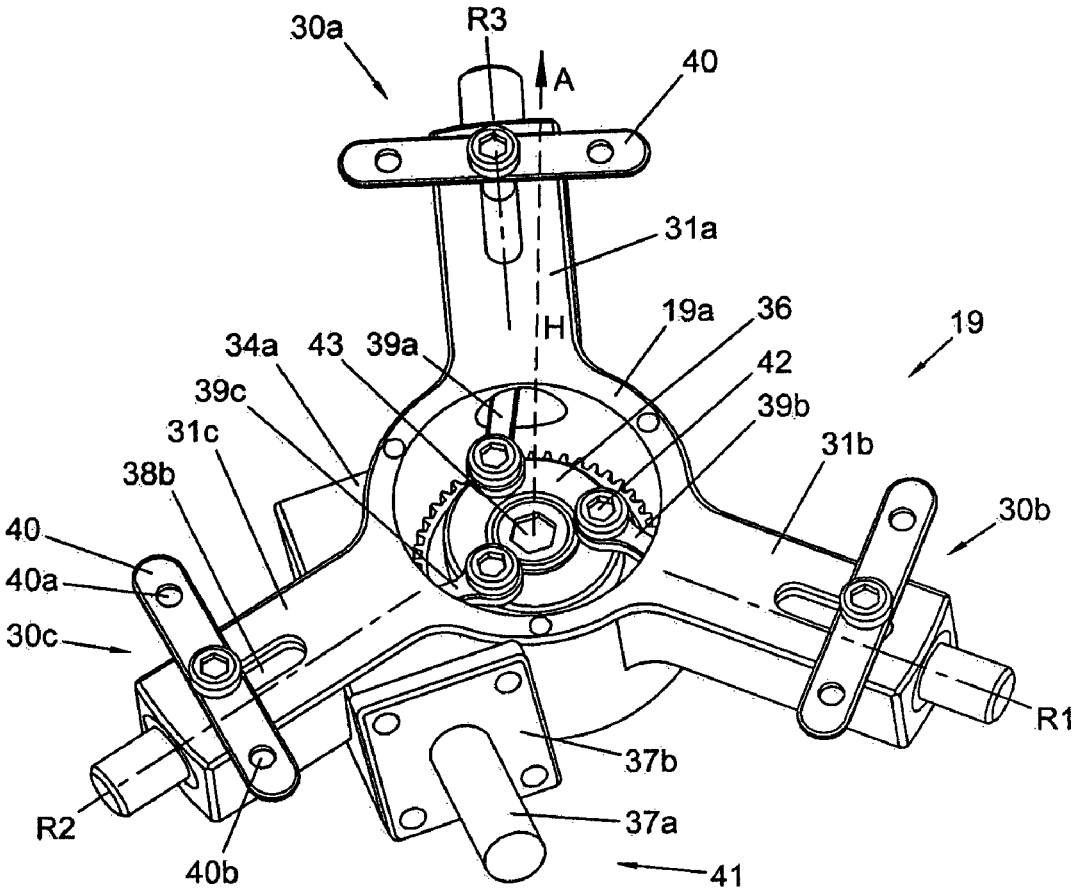
FIG. 3 shows a schematic perspective view of a tensioning star of the kettledrum of FIG. 1.
Figure 4:
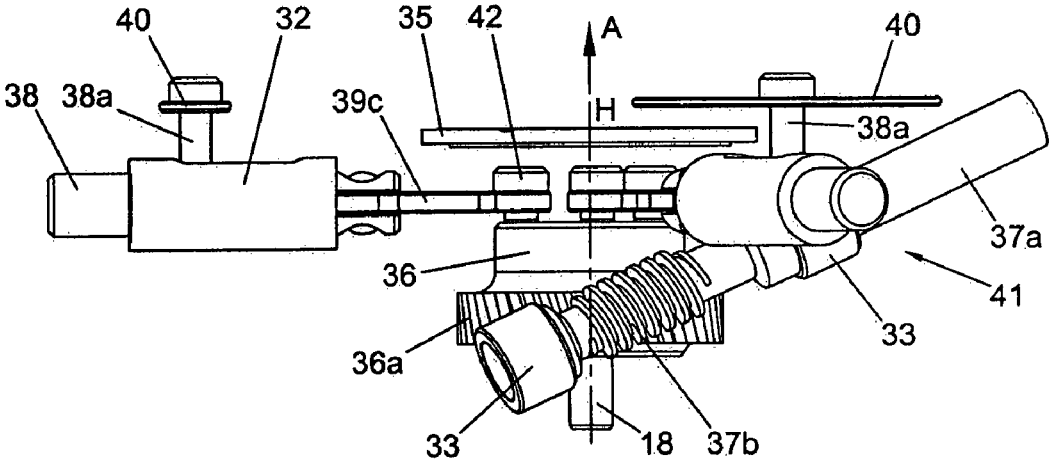
FIG. 4 shows a schematic side view of the tensioning star as shown in FIG. 3.
Figure 5:
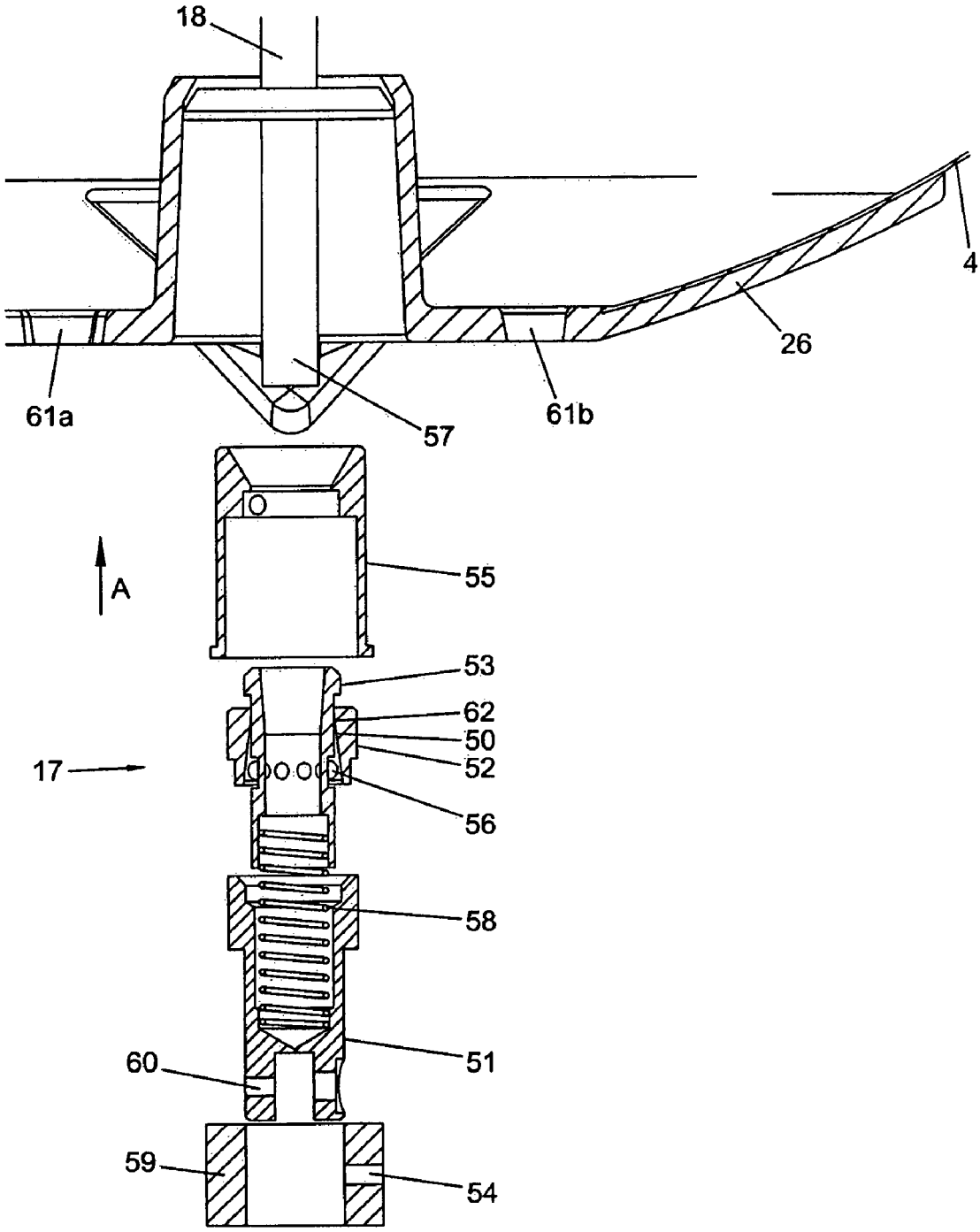
FIG. 5 shows a schematic view of a cross section of a coupling module of the kettledrum of FIG. 1.

FIGS. 3 and 4 shows a schematic perspective view and a schematic side view, respectively, of a tensioning star 19. The tensioning star 19 is present in the kettle 4 such that the central axis H of the tensioning star 19 and the central axis K of the kettle 4 substantially coincide. The tensioning star 19 is further provided with an engaging element 43, designed as a bolt, for engaging an operating mechanism for adjusting the tensioning star 19 in an axial adjusting direction A, substantially parallel to a central axis H of the tensioning star 19. The tensioning star 19 is also provided with a plurality of arms 31*a*, 31*b*, 31*c*, extending substantially in radial directions R1, R2, R3, which are all provided with a coupling element 30*a*, 30*b*, 30*c* for coupling to the tensioning rod construction attached to the skin 101. Further, an adjusting device is shown for adjusting the distance between coupling element 30*a*, 30*b*, 30*c* and the central axis H of the tensioning star 19.

The coupling elements 20*a*, 30*b*, 30*c* each comprise a shaft 38 which is guidingly received in a slide bearing 32, preferably made in bronze which allows an axial adjustment in the substantially axial direction R1, R2, R3 relative to the central axis H of the tensioning star 19. Transversely to the axis 38, a projecting element 38*a* is attached which, via an opening 38*b*, reaches outwards into the slide bearing 32 and bears a tiltable equalizer element 40, also called tensioning plate, of which both ends are designed for coupling to a respective tensioning rod 2 of the tensioning rod construction. To that end, the ends mentioned are provided with openings 40*a*, 40*b* in which the tensioning rods 2 can hook. Through the use of an equalizer construction, any differences in tensile force between the tensioning rods 2 attached to the coupling element are equalized so that an equal tensile force in circumferential direction is obtained. However, it is also possible to design the coupling elements differently, for instance with a rigid coupling construction to the tensioning rods.

A central, annular part 19*a* of the tensioning star 19 forms, together with the arms 31, 31*b*, 31*c* an integral tensioning star, preferably formed as a casting piece. Naturally, the annular part 19*a* and the arms can also be designed differently, for instance as separate elements which are coupled to each other with the aid of a connecting technique.

The adjusting device comprises a disc 36, arranged centrally relative to the central axis H of the tensioning star and pivotal about the central axis H, and a number of crankshafts 39*a*, 39*b*, 39*c* pivotally attached to the disc 36 such that the crankshafts are pivotally attached by a first end via a bolt connection 42 to the disc 36 and are connected, by an opposite second end, to a coupling element 30*a*, 30*b*, 30*c* respectively, of an arm 31*a*, 31*b*, 31*c*. By pivoting the disc 36 around the central axis H of the tensioning star 19, the two ends of the crankshafts 39*a*, 39*b*, 39*c* and hence also the coupling elements move away from the central axis H of the tensioning star 19. As the coupling elements move via the tensioning rod construction, the tension in the skin 102 of the kettledrum 100 changes too. Thus, the skin tension of the skin 102 can be set with the aid of the adjusting device, independently of a position of the operating mechanism for adjusting the tensioning star 19 in an axial adjusting direction A, and without adjusting the operating mechanism. The balance with the pedal described hereinafter remains unadjusted.

The disc 36 is accommodated in the annular part 19*a* of the tensioning star. Further, the crankshafts 39*a*, 39*b*, 39*c* reach through the hollow arms 31, 31*b*, 31*c* of the tensioning star 19 so that a compact construction is obtained. The annular part of the tensioning star 19 is covered with the aid of a covering plate 35.

FIGS. 3 and 4 further show an operating element which is provided with a worm 37*b* which cooperates with the disc 36 designed as worm wheel. To that end, the disc 36 is provided with a toothing 36*a* provided on the radial outer edge. The worm 37*b* is borne by an operating shaft 37*a* which is rotatable via guide elements 38, preferably designed in bronze. A first end of the operating shaft 37*a* is located, together with the worm 37*b*, in a housing 34*a* covered by a covering plate 34*b*. A second end of the operating shaft 37*a* located opposite the first end reaches through an opening of the kettle 4 and is provided with a handle for enabling operation of the adjusting device. Upon pivoting of the operating shaft 37*a*, the worm 38*b* drives the worm wheel 36, so that the distance between the coupling elements 30, 30*b*, 30*c* and the central axis H of the tensioning star 19 varies. Through the use of a worm wheel construction, in an advantageous manner, a particularly compact construction is obtained while furthermore, a particularly accurate setting of the skin tension of the skin 101 can be obtained.

Thus, the adjusting device is designed for adjusting, preferably simultaneously, the coupling elements 30*a*, 30*b*, 30*c* of a plurality of arms 31*a*, 31*b*, 31*c* so that a tension variation of the skin 101 is realized substantially uniformly over the circumferential direction. However, alternatively, the adjusting device can be designed for separately adjusting the distance between coupling element and central axis H of the tensioning star, so that a specific tensioning rod can be adjusted. The described adjusting device effects an adjustment of the coupling elements in a substantially radial direction relative to the tensioning star. However, in principle, it is also possible to design the tensioning rod construction such that the adjusting device realizes an axial adjustment, virtually parallel to the axial adjusting direction A, for instance when the lower rods 27 run substantially parallel to the axial adjusting direction A.

In another embodiment, the adjusting device segment designed differently, optionally without pivotal disc and/or worm, but with, for instance, a slide mechanism.

Together with the adjusting device, the tensioning star 19 forms a device according to the invention for setting skin tension. It is noted that all sorts of variations are possible. For instance, in another embodiment according to the invention, not all arms are provided with a coupling element for coupling to the tensioning rod construction. One of the arms can for instance be designed without coupling element when the number of tensioning rods of the tensioning rod construction is smaller than the number of arms of the tensioning star 19. In the embodiment shown, the tensioning rod construction comprises six tensioning rods 2, 28, 27 which are evenly distributed in circumferential direction. However, the tensioning rod construction can also comprise a different number of tensioning rods, for instance eight tensioning rods.

The lower segment 26 of the kettle 4 is borne by supporting elements 25 which are attached to the upper part 25*a* of a supporting column 25*b*. Via a threaded spindle construction 15, the supporting column 25*b* bears on the foot 9. The foot 9 is provided with two pivotal bearing arms 10 each equipped with a wheel 5 so that the kettledrum can easily be displaced but can also be stably set down. The foot 9 further comprises a hinged pedal 8 with which a player can set the pitch of the kettledrum. The pedal 8 forms part of the operating mechanism for adjusting the tensioning star in axial adjusting direction. For forming the threaded spindle construction 15, the bearing column 25*b* is provided with external screw thread which corresponds to internal screw thread in a receiving cavity of the foot 9. By rotating the foot 9 about the bearing column 25*b*, the height of the kettle 4 can be set so that the kettledrum can be played in an ergonomic manner by a player of any length.

The operating mechanism for adjusting the tensioning star 19 in axial adjusting direction A comprises a first connecting rod 18 engaging by a first upper end the engaging element 43 of the tensioning star 19. The operating mechanism further comprises a second connecting rod 16 attached by a first upper end to a coupling module 17 which is couplable to a second, lower end of the first connecting rod 18 reaching downwards through an opening at the underside of the kettle 4. The second connecting rod 16 comprises two segments 16, 18 mutually connected via an additional screw spindle 25*c*. The lower segment 18 of the second connecting rod is hingedly attached to a coupling piece 13, which is hinged to the foot 9. Through the use of the additional screw spindle 25*c*, the height of the kettle 4 can be set, independently of the balance between the pedal 8 and the tensioning star 19. The operating mechanism further comprises a pedal connecting rod 11 which is arranged between the coupling piece 13 and the pedal. The operating mechanism also comprises a biased spring element arranged in a bushing 23, of which an engaging point 21 is also connected to the coupling piece 13. Here, the bushing is rigidly attached to the foot 9. The bias of the spring element 22 is adjustable with the aid of a rotatable handle 24.

By tilting the pedal 8, the pedal connecting rod 11 adjusts and hence, via the coupling piece 13 functioning as tumbler element, also both segments 14, 16 of the second operating rod, and the first operating rod 18 adjust in the axial adjusting direction A. As a result, the tensioning star 19 too will adjust in axial adjusting direction. Then, by means of the tensioning rod construction, the tension of the skin is varied. As the spring element 22 too engages the coupling piece 13, a balance of forces is formed, dimensioned such that the pedal remains in any arbitrary position, also without application of a static force thereto.

The coupling module 17 comprises a hollow block 59 rotatably included in the supporting column 25*b* and attached to the second operating rod 16. The coupling module 17 further comprises a first substantially cylindrical body 51 with a bore in which a spring element 58 is provided. The first cylindrical body 51 is rigidly attached to the block 59 via a bolt connection and substantially horizontal bores 54, 60 provided with internal screw thread in the body 51 and the block 59. The coupling module also comprises a second substantially cylindrical body 53 provided with a continuous bore with varying diameter. The lower part of the bore accommodates the spring element 58, while the upper part of the bore tapers upwards and outwards for accommodating the second end 57 of the first connecting rod 18. The second substantially cylindrical body 53 is further provided with a clamping construction for clampingly coupling the second end 57 of the first connecting rod 18. The coupling module 17 also comprises a sleeve 55 which surrounds the second substantially cylindrical body 53.

The clamping construction of the coupling module 17 is designed for a clamping coupling on the first connecting rod within a predetermined range of adjustment of the first connecting rod in the axial adjusting direction A, between a minimum distance and a maximum distance relative to the skin, and for releasing the clamping coupling when, through an adjustment of the second connecting rod 16, the distance between the first connecting rod 18 and the skin becomes smaller than the minimum distance of the range of adjustment.

To that end, the clamping construction comprises a series of balls 56 arranged in circumferential direction around the second cylindrical body 53 for a radially inwards clamping engagement of the second end 57 of the first connecting rod 18, further comprising a ring 52 slideable in axial adjusting direction A for radially confining the balls 56 under a bias, while the ring 52 is provided in axial direction A with a tapering inner profile 50, while the tapering part 61 of the ring 52 is pressed, in the predetermined range of adjustment of the first connecting rod 18, under spring action, towards the balls 56 with the ring 52 designed to adjust away from the balls 56 with the tapering part 61 of the inner profile 50 when the distance between the first connecting rod 18 and the skin becomes smaller than the minimum distance of the range of adjustment. The slideable ring 52 in manufactured substantially from a resilient material.

During use of the kettledrum 100, the balls 56 are pressed inwards under spring action of the ring 52, to clampingly engage the end 57 of the first connecting rod 18. As a result, the first and second connecting rod 16, 18 are coupled to each other. Here, the first connecting rod 16 is height variable in the range of adjustment, so that the kettledrum can be operated normally.

When uncoupling the kettle 4, the second connecting rod 16, including the coupling module 17, is pressed upwards relatively far, so far that the distance between the first connecting rod 18 and the skin becomes smaller than a predetermined minimum marginal value of the range of adjustment. Here, the pedal 8 is brought into an extreme rearward position. With the coupling module 17 in the high position, an element of the foot pushes the second cylindrical body 53 downwards, against spring action, so that the ring 52 relative to the body 53 moves away from the spring, whereby the force applied by the ring to the balls 56 is reduced and even disappears, yet with the balls remaining between the ring 52 and the body. As a result, the clamping action of the balls is released. The kettle 4 can then be disassembled.

When assembling the kettle 4, the procedure takes place in reverse order. When forcing the second connecting rod 16 downwards from the high position of the coupling module 17, the ring 52 moves under spring action relative to the second cylindrical body 53, so that the balls 56 are confined and clampingly engage the second end of the first connecting rod.

Through the use of the above-described coupling module 17, the kettle 4 can be relatively simply be separated from the foot, while still, during use of the kettledrum, the operating mechanism is not hindered.

The operating rod 11 is oriented substantially transversely relative to the axial adjusting direction A. Further, the force provided by the biased spring element 22 is oriented from the coupling piece 13 in a direction between the tensioning star 19 and the pedal 8. As a result, the pedal can be held in balance in various positions. It appears to be preferred here that the direction of the force provided by the spring element makes a smaller angle with the axial adjusting direction A than with the orientation of the operating rod 11.

The operating rod 11 further comprises two spring elements which cooperate with stops mounted on the inside of the foot 9. Here, a first spring 12*a* enters into operation when the pedal 8 is tilted so far that the coupling module 19 starts releasing the second end of the first connecting rod 18. Then, a second spring 12*b* enters into operation when the uncoupling actually starts, to prevent an undesired adjustment by unbalance of the pedal 8.

After disassembly of the kettle 4, the pivotal arms 10 can be pivoted in the direction of the foot 9, so that the dimensions of the foot as a whole decrease even further. Optionally, the wheels 5 are designed as castor wheels and, with the arms 10 in collapsed condition, are collapsible, which effects a still further reduction of the foot as a whole. Further, the foot can be provided with a grip, so that the whole can easily be transported by hand. The grip can be of stationary design, such as a fixed grip, or in another manner, for instance as a telescopic grip, such as with a trolley, so that the foot can easily be lifted on one side and be rolled forward with the aid of the castors.

Upon assembly of the kettledrum 100, the arms 10 are folded out and the kettle 4 is set on the supporting elements 25, whereupon the lower end 57 of the first connecting rod 18 is attached to the coupling module 17 as described hereinabove. The supporting elements 25 are rigidly attached to the top part 25*a* of the supporting column 25*b*. The underside of the kettle 4 is provided with clamping elements 26 having a shape matching the supporting elements 25 so that the kettle can find the position relative to the foot 89 in a self-seeking manner. The supporting column further comprises a clamping disc with an internal thread profile which cooperates with the outer thread profile of the upper part 25*a* of the supporting column 25*b*. The clamping disc is provided with upstanding clamping elements (not shown) which reach through slot-shaped openings 61*a*, 62*b* of the supporting elements 25 and the profile elements 26 of the kettle. By pivoting the clamping disc relative to the supporting elements 25 and the profile elements 26, a strong coupling is effected between the kettle and the foot. To this end, the thread profile of the upper part of the supporting column 25*b* has a relatively great pitch.

As the described kettledrum is designed so it can be disassembled, it is highly suitable for transport in compact modules. Owing to the easy to adjust height of the kettle, the kettledrum is also, in principle, suitable for users of different lengths.

The invention is not limited to the exemplary embodiments described here. Many variants are possible.

For instance, all sorts of adaptations can be realized with regard to form and design of, for instance, the kettle, the coupling between the tensioning star and the skin etc. The coupling between the kettle and the foot can also be designed differently.

In addition, a device for setting skin tension can be of multiple design, for a plurality of skins to be tensioned.

Also, such a device can be utilized with a percussion instrument or for instance in measuring equipment where use is made of tensioned skins.

Further, slide bearings and/or bearing bushes can be manufactured not only from bronze but also from other materials, for instance from specific raw materials. Such variants will be clear to the skilled person and are understood to fall within the scope of the invention, as set forth in the following claims.

The invention claimed is:

1. A device for setting tension of a skin used in a musical instrument comprising a tensioning star provided with an engaging element for engaging an operating mechanism for adjusting the tensioning star in an axial adjusting direction, substantially parallel to a central axis of the tensioning star, and provided with a plurality of arms extending in substantially radial directions, of which at least a part is provided with a coupling element for coupling to a tensioning rod construction attachable to the skin, further comprising an adjusting device for adjusting a distance between the coupling element and the central axis of the tensioning star.

2. The device according to claim 1, wherein the coupling element is adjustable relative to the tensioning star in a substantially radial direction.

3. The device according to claim 2, wherein a central part of the tensioning star together with a number of arms forms an integral tensioning star.

4. The device according to claim 1, wherein the adjusting device is designed for substantially simultaneously adjusting coupling elements of a plurality of arms.

5. The device according to claim 1, wherein the adjusting device comprises a pivotal disc disposed centrally relative to the central axis of the tensioning star and a crankshaft, pivotally connected to the disc, which is connected at an end to the coupling element of a corresponding one of the arms.

6. The device according to claim 1, further comprising an operating element provided with a worm which cooperates with a disc, the disc being configured as a worm wheel.

7. The device according to claim 1, wherein a coupling element of an arm comprises an equalizer of which both ends are designed for coupling to a respective tensioning rod of the tensioning rod construction.

8. The device according to claim 1, wherein the operating mechanism comprises a first connecting rod which engages by a first end the engaging element of the tensioning star, and a second connecting rod attached by a first end to a coupling module which is couplable to a second end of the first connecting rod, wherein the coupling module comprises a clamping construction which provides a clamping coupling to the first connecting rod within a predetermined range of adjustment in the axial adjusting direction between a minimum distance and a maximum distance relative to the skin, and which releases the clamping coupling when, through an adjustment of the second connecting rod, the distance between the first connecting rod and the skin becomes smaller than the minimum distance of the range of adjustment.

9. The device according to claim 8, wherein the clamping construction comprises a series of balls arranged in circumferential direction for radially inwards clampingly engaging the second end of the first connecting rod, further comprising a ring slideable in axial adjusting direction for radially confining the balls under a bias, wherein the ring is provided in the axial direction with a tapering inner profile, wherein the tapering part of the ring is pressed, under spring action, in the predetermined range of adjustment of the first connecting rod, towards the balls and wherein the ring is designed to adjust away from the balls with the tapering inner profile when the distance between the first connecting rod and the skin becomes smaller than the minimum distance of the range of adjustment.

10. The device according to claim 8, wherein the coupling module clampingly engages with the second end of the first connecting rod when the first connecting rod is included from an uncoupled condition into the coupling module and when the second connecting rod is forced downwards.

11. The device according to claim 8, wherein the operating mechanism further comprises a hingedly arranged coupling piece which is coupled to the second connecting rod, an operating rod attached to a pivotal pedal and to a biased spring element, wherein the operating rod is oriented substantially transversely relative to the axial adjusting direction and wherein a force provided by the biased spring element is oriented from the coupling piece in a direction between the tensioning star and the pedal.

12. The device according to claim 11, wherein the direction of the force provided by the spring element makes a smaller angle with the axial adjusting direction than with the orientation of the operating rod.

13. A musical instrument, provided with a skin and a device according to claim 1, wherein the tensioning rod construction is attached to the skin.

14. The musical instrument according to claim 13, wherein the instrument is a kettledrum.

* * * * *